United States Patent [19]

Kupperman et al.

[11] 4,158,257

[45] Jun. 19, 1979

[54] PANTOGRAPH INTEGRALLY FORMED OR MOLDED OF PLASTIC MATERIAL

[75] Inventors: Sam Kupperman, Chicago; Dennis Kupperman, Glenview, both of Ill.

[73] Assignee: RB Toy Development Co., Skokie, Ill.

[21] Appl. No.: 942,619

[22] Filed: Sep. 15, 1978

Related U.S. Application Data

[63] Continuation of Ser. No. 791,006, Apr. 26, 1977, abandoned, which is a continuation-in-part of Ser. No. 715,283, Aug. 18, 1976, abandoned.

[51] Int. Cl.[2] ..... B43L 13/10

[52] U.S. Cl. ..... 33/25 R

[58] Field of Search ..... 33/25 R, 25 B

[56] References Cited

U.S. PATENT DOCUMENTS

| | | | |
|---|---|---|---|
| 228,062 | 5/1880 | Gregory | 33/25 B |
| 978,012 | 12/1910 | Foster | 33/25 B |
| 3,160,956 | 12/1964 | Mercorelli | 33/25 B |
| 3,858,324 | 1/1975 | Padowicz | 33/25 R |

FOREIGN PATENT DOCUMENTS

| | | | |
|---|---|---|---|
| 398390 | 9/1933 | United Kingdom | 33/25 B |

OTHER PUBLICATIONS

"Modern Plastics," pp. 122–123, 4/45.

*Primary Examiner*—Harry N. Haroian
*Attorney, Agent, or Firm*—Vogel, Dithmar, Stotland, Stratman & Levy

[57] ABSTRACT

A pantograph which is integrally molded of plastic material and as an integral unit comprises a plurality of links, with certain of said links having an integrally formed leg, pin and bearings, with one of the links having means for receiving and supporting a writing instrument. The integral unit is such that the various links and parts may be disconnected from their integrally formed unit and assembled and connected so the links pivot with respect to each other and same is operated as a pantograph. The parts being pivotally connected by their own means without the use of extraneous fastening means.

Two alternate embodiments are shown both having a clip to secure the stationary end of the pantograph to a writing surface with one being provided with a movable pointer thereby allowing the pantograph to be used for two to one reproductions or one-half to one reproductions.

5 Claims, 9 Drawing Figures

FIG. 1
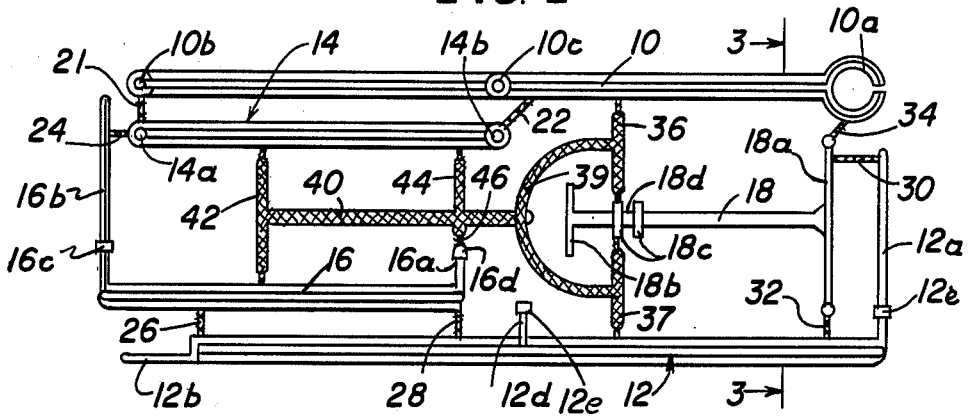
FIG. 2
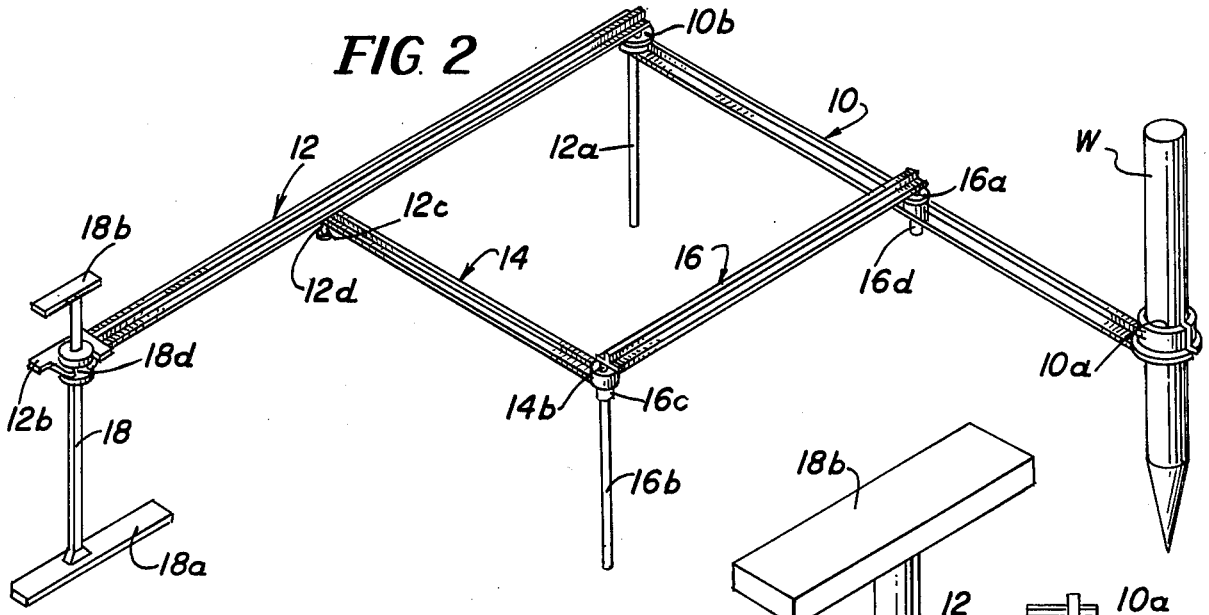
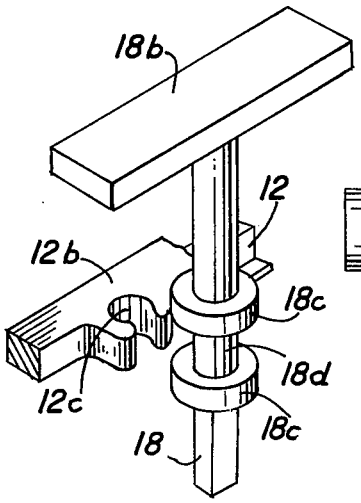
FIG. 4
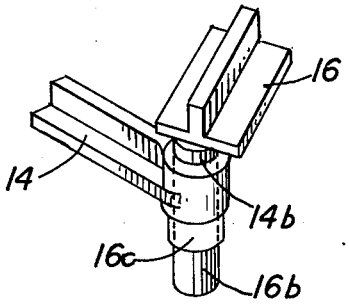
FIG. 5
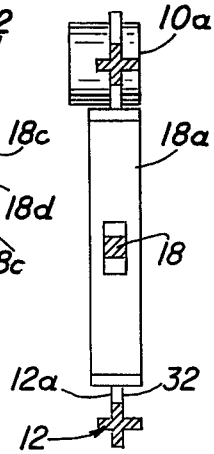
FIG. 3

PANTOGRAPH INTEGRALLY FORMED OR MOLDED OF PLASTIC MATERIAL

Related Applications

This is a continuation of application Ser. No. 791,006 filed Apr. 26, 1977 now abandoned, which application is a continuation-in-part of application Ser. No. 715,283, filed Aug. 18, 1976, for A PANTOGRAPH INTEGRALLY FORMED OR MOLDED OF PLASTIC MATERIAL, now abandoned.

Brief Summary of the Invention

One of the objects of this invention is to provide a pantograph in which all of the components forming said pantograph are integrally plastic molded as a single unit to the end that it may be economically produced and will pass the Government's safety requirements and can be placed in a cereal or food package as a give-away without an overwrap.

Another object of this invention is to provide an integrally formed plastic molded structure in which all of the parts are connected together as an integral unit when molded, yet may be readily detached and separated from said integrally formed structure with the parts pivotally connected through their formed legs and pins with the bearings formed in said structure, all of said parts being connected without extraneous fastening elements.

Brief Description of the Drawings

FIG. 1 is a plan view of the integrally plastic molded structure with the connecting portions which are to be scrapped when the parts are detached being shown cross hatched;

FIG. 2 is a view of the pantograph formed from the molded structure of FIG. 1;

FIG. 3 is a view taken on lines 3—3 of FIG. 1;

FIG. 4 is an enlarged view showing the manner of securing the anchor leg to one of the long links;

FIG. 5 is an enlarged view showing the connection between the two short links at the tracer leg;

Description of the Preferred Embodiment

Figure 6:
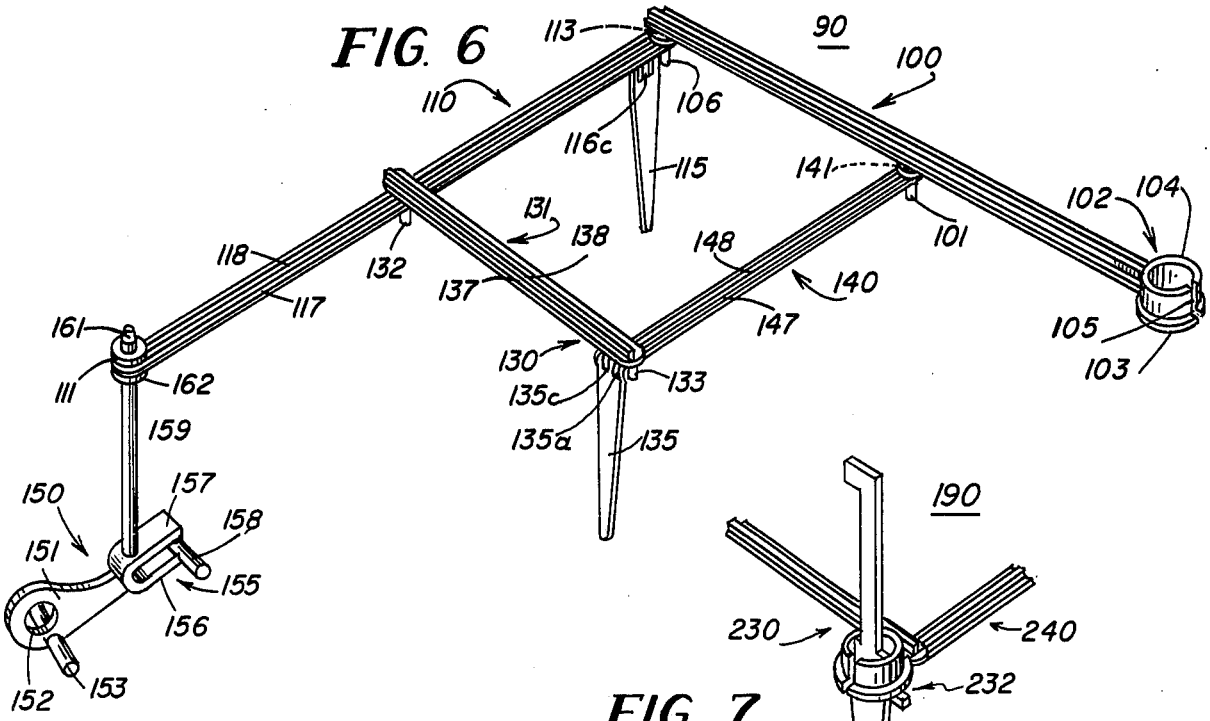
FIG. 6 is a perspective view of a second embodiment of the pantograph.

The parts forming the pantograph are all molded of plastic as an integral unit in the form shown in FIG. 1, so that the parts are molded connected together as shown in said figure and the parts will be described by similar reference numerals in their relationship as molded in FIG. 1 and as embodied when assembled to form the pantograph of FIG. 2.

The integrally formed unit comprises a first long link generally indicated by the numeral 10, a second long link indicated by the numeral 12, a short link indicated by the numeral 14, another short link indicated by the numeral 16, and an anchor leg generally indicated by the numeral 18. The first long link 10 is formed with an annular enlarged split opening **10*a* at one end thereof which forms a socket to receive and hold a writing instrument as will be subsequently described. The opposite end of said link 10 is formed to provide an end bearing 10*b* and said link is provided intermediate its opposite ends with a similar bearing 10*c***.

The second long link 12 has a support leg **12*a* formed at one end, an offset extension 12*b* at the other end, with said offset extension having a C-shaped opening 12*c*, and a pin 12*d* intermediate the opposite ends of said link. The pin 12*d* and leg 12*a* are at right angles to the major axis of link 12. The pin 12*d* is of annular shape and has an enlargement at the lower end thereof defining a shoulder 12*e*. The leg 12*a* has an annular enlargement which defines a shoulder 12*e*. Such shoulder is spaced from the second long link 12. The opposite end of the second long link 12 has the previously mentioned C-shaped opening 12*c* which is adapted to receive the anchor leg 18 which will be more fully described hereinafter. The C-shaped opening 12*c* permits the insertion therein of the anchor leg 18 so that the anchor leg 18 is pivotally secured to long link 12. The C-shaped opening 12*c* thereby serves as a bearing for the anchor leg 18. The extension 12*b* of link 12, which contains the C-shaped opening 12*c*, has a reduced thickness in contrast to the thickness of the link 12. Each of the links, namely the first and second long links 10 and 12 and the short links 14 and 16, are cross-shaped in transverse section as best shown in FIG. 3** for the purpose of providing strength for each of the links with a minimum of plastic material and also for facilitating molding.

The short link 14 has a bearing at each of its opposite ends indicated by the numerals **14*a* and 14*b*, one end of which is adapted to engage the pin 12*d* of the second link 12 with the opposite end bearing 14*b* receiving the tracing leg 16*b* of short link 16. The short link 16 has a short pin 16*a* at one end and the aforementioned leg 16*b* at the opposite end. The leg 16*b* has a pivotal connection with the bearing 14*b* of the short link 14 and leg 16*b* serves as a tracer member which is adapted to be manually engaged. Leg 16*b*** also functions as a support leg.

The anchor leg 18 has at one end a flat strip **18*a* which as seen in FIG. 2, rests on the supporting surface. The opposite end of the anchor leg has a short top strip 18*b* and spaced below said top strip and in spaced relation to each other (FIG. 4) are a pair of spaced annular members or collars 18*c* defining therebetween a short section 18*d* of said leg 18**.

The aforedescribed elements comprise the elements forming the pantograph shown in FIG. 2 and they are identified by the same numbers in the integrally molded portion shown in FIG. 1. When molded as in FIG. 1, the aforesaid parts have to be connected so that they all form an integral unit and the connecting members or pieces, which connect the various parts, are also of plastic and will now be described. They are cross hatched in FIG. 1 for purposes of clarity and all of said connecting pieces or members become scrap when the parts are detacted to from the pantograph of FIG. 2.

Reference will now be made in FIG. 1. Connecting the short link 14 to the first long link 10 are short connectors 21 and 22. Connecting the short link 14 to the tracer leg **16*b* is a short connector 24. Connecting the short link 16 to second long link 12 are connectors 26 and 28. Connecting the strip 18*a* of anchor leg 18 to the leg 12*a* is connector 30 and connecting one end of said strip 18*a* to second long link 12 is connector 32 and connecting the opposite end of said strip to the socket 10*a* on the first long link 10 is connector 34. Connecting the anchor leg 18 to the first and second long links 10 and 12 are connectors 36 and 37. Both of said connectors extend from one of the collars 18c to their respective long links 10 and 12. The portions of said connectors 36 and 37 immediately adjacent the collar 18c and their respective links 10 and 12 are of a reduced thickness to permit breaking away of the parts. Extending between the connecting strips 36 and 37 is an arcuate-shaped connector 39. Connected to said arcuate-shaped connector 39 centrally thereof is an elongated connector 40 having at one end thereof a cross connector 42 with the cross connector 42 connected at its opposite ends to short links 14 and 16. Connector 44 connects connector 40 to short link 14 and short connector 46 connects connector 40 to pin 16a. The opposite ends of connector 42, the ends of connectors 44 and 45 are all of reduced thickness to permit breaking away. The aforementioned connector pieces (all cross hatched) all form scrap when the elements shown in FIG. 1 are disconnected from each other, so that the pantograph shown in FIG. 2** may be formed.

The tracer leg 16b has an enlargement which forms a shoulder 16c and the pin 16a has an enlargement which forms a shoulder 16d.

Each of the bearings, which have been described, is formed by a circular opening surrounded by a bossing having sufficient height on their respective links so that the pivot pin or the leg which is supported therein has sufficient bearing surface to be firmly supported in said bearings and to permit the pivotal movement of the parts relative to each other at said bearings. FIG. 5 is an enlargement of one of such bearings and shoulders. The other bearings and shoulders are similarly constructed. Also, the enlargements described, which form the shoulders, permit the respective legs or pins to be connected by passing same through said bearings to connect same, yet after same are connected, the enlargements or shoulders will maintain the parts in a connected relationship and will prevent the parts from slipping off with respect to their connected members. However, if it should be desired to dissassemble the connected links, they can be slid off past their respective shoulders. However, when once the parts are connected to form a pantograph, there would be no advantage in disassembling same. It is believed that the aforementioned description and the identical numbered parts of FIG. 1 to that of FIG. 2 showing the pantograph assembled will suffice to show the manner in which they are connected to form the pantograph. However, the following is a brief summary of same.

After the parts are disassembled from that of FIG. 1 by breaking away the various connecting members, first long link 10 is pivotally connected through its end bearing 10b to the support leg 12a of second long link 12. The shoulder 12e on leg 12a will prevent disengagement between long links 10 and 12. Short link 16 is pivotally connected through its pin 16a to intermediate bearing 10c of long link 10 and the shoulder 16d on pin 16a will prevent disengagement with first long link 10. The opposite end of short link 16 is pivotally connected through its tracer leg 16b to bearing 14b of short link 14. The shoulder 16c on tracer leg 16b will prevent disengagement with said link 14. The opposite end of short link 14 is pivotally connected through bearing 14a with pin 12d of second long link 12 and the shoulder 12e of pin 12d will prevent disengagement therefrom. Anchor leg 18 is pivotally connected to the opposite end of second long link 12 by snapping portion 18d of said leg into the C-shaped end 12c at the end of link 12 and the two spaced collars 18c on anchor leg 18 will be positioned above and below the extension 12b on said long link 12.

When the pantograph is positioned on a supporting surface and a writing instrument W, such as a pen, pencil or stylus, is inserted in the socket 10a on the end of first link 10, the pantograph will be supported on leg 12a, tracer leg 16b anchor leg 18. The strip 18a of achor leg 18 rests flat on the surface and may be held by the fingers of the hand to hold the pantograph while operating same. The tracer leg 16b forms the tracing member in that it is positioned over the object or picture to be traced. By holding the writing instrument W with one hand and the anchor strip 18a with the other and moving the tracer leg 16b over the picture or object to be traced, the object is reproduced through the writing instrument in a form larger than the original object from which it is traced. The parts will be pivoted with respect to each other so that it operates as a pantograph and the links and the various elements will be firmly secured so that they will not be accidentally displaced from each other. The pantograph may be collapsed by pivoting the first and second long links 10 and 12 towards each other, thereby collapsing the short links 14 and 16.

While the size and dimensions may be of any desired, it is recommended that for a give-away, the integrally formed structure be of a generally rectangular shape as in FIG. 1 having a width of approximately 2 inches and a length of approximately 5¼ inches.

With this construction, a pantograph may be produced so inexpensively that it may be put into a cereal food package in the form illustrated in FIG. 1. As same is integrally molded and the parts are maintained in their assembled relationship as in FIG. 1, when in the package, it presents no safety hazard and will pass the Consumer Products Safety Commission tests as to size and safety and it allows the integral product to be inserted into a food product package without an overwrap. By virtue of the integrally formed construction it may be economically produced and can be used as a give-away item in packaged cereal products and the like.

Figure 8:
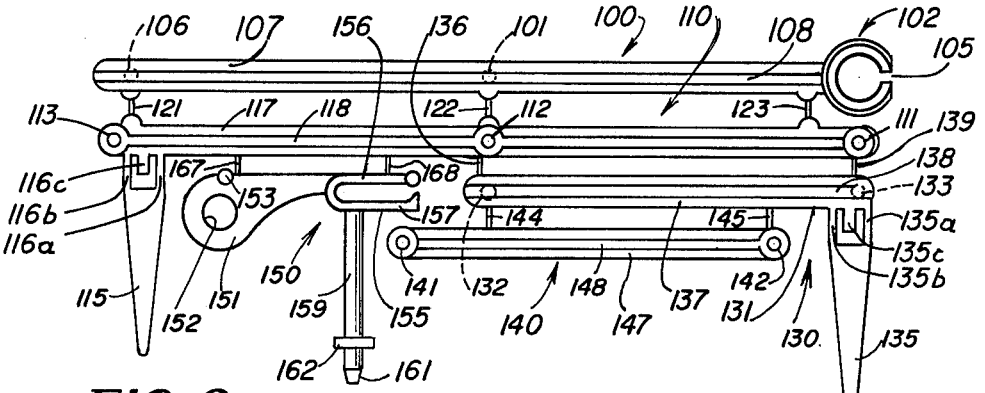
FIG. 8 is a plan view of the integrally molded plastic structure with the parts necessary to form the pantograph illustrated in FIG. 6.

Referring to FIG. 6 of the drawings, there is disclosed a second embodiment 90 of the pantograph of the present invention. The pantograph 90 in the as molded condition is illustrated in FIG. 8 and includes a long link 100 having a pivot pin or stub shaft 101 extending centrally thereof and perpendicularly thereto. At one end of the link 100 is an annular split ring holder 102, which is provided with a flat outwardly extending flange 103 and an upstanding cylindrical wall 104. The split 105 severs completely the wall 104 and the flanges 103 to accommodate writing instruments of various sizes. The link 100 further includes a pivot pin 106 at the distal end opposite the holder 102, which pivot is of the same shape and configuration as the pivot pin 101. The link 100 is cruciform in cross section with a flat member 107 and upstanding ridges 108 to give the link 100 sufficient strength in use.

In the as molded condition shown in FIG. 8, there is further provided another long link 110, which has a bearing opening 111 at one end thereof, a bearing opening 112 centrally thereof and a bearing opening 113 at the other end thereof. Each of the bearings 111, 112 and 113 is sized to receive therein an associated pivot pin or stub shaft such as those described above. At the end of the link 110 adjacent the bearing 113, is an alternate pointer 115 which is provided with a cut-out portion at the juncture between the link 110 and the pointer 115 forming straps 116*a* and 116*b* and a shoulder 116*c*, for a purpose to be explained. The long link 110 is cruciform shaped as was the link 100 with a flat member 117 having upstanding ridges 118 to provide the required strength.

The long link 110 is connected in the as molded condition to the long length 100 by means of three connectors 121, 122 and 123, respectively adjacent the pivot pins 106, 101 and the split ring holder 102. These connectors 121, 122 and 123 are intended to be removed by the user to assemble the pantograph in the condition shown in FIG. 6, and to that end, the connectors are of reduced diameter and easily may be severed.

A pointer member 130 is comprised of a short link 131 having a pivot pin or stub shaft 132 extending perpendicularly from the link at one end thereof and a pivot pin 133 extending perpendicularly from the link at the other end thereof in the same direction as the pin 132. Adjacent the pivot pin 133, is a pointer 135 which is elongated and tapers from the juncture with the link 131 to the distal end thereof adjacent the connection between the link 131 and the pointer 135 is a cut-out area forming straps 135*a* and 135*b* with a shoulder or tongue 135*c* therebetween. The link 131 like the other links 100 and 110, is cruciform in cross section with a flat member 137 and upstanding ridges 138 to provide the required strength. The pointer member 130 is connected in the as molded condition to the long link 110 by connectors 136 and 139 each of a reduced diameter and adapted to be easily severed.

Another short link 140 is provided and has a bearing 141 at one end thereof and a bearing 142 at the other end thereof, each of the bearings 141 and 142 being provided with apertures sized to receive therein the hereinbefore described pivot pins. The short link 140 in the as molded condition is connected to the short link 130 by means of connectors 144 and 145. The short link 140 is cruciform in cross section with a flat member 147 and an upstanding ridges 148, all as previously described with respect to the other links in this pantograph 90.

Finally, the pantograph 90 includes a holder 150 which is provided with an enlarged circular tab end 151 having an aperture 152 therein, a dowel 153 extends perpendicularly to the tab 151 and provides a finger grip. The holder 150 includes a clip section 155 which is comprised of spaced apart prongs 156 and 157 with the prong 156 having a dowel 158 extending along the edge thereof perpendicular to the longitudinal extent of the holder 150. A rod 159 extends upwardly (in use) or perpendicularly away from the prong 156 and is provided with a beveled end 161 and a circular flange 162, for a purpose hereinafter set forth. The holder 150 is connected to the long link 110 by means of connectors 167 and 168, each of the same dimensions as previously described.

In use, the pantograph 90 is removed by the user in the configuration illustrated in FIG. 8 and with a pair of wire cutters or the like, the various connectors 121, 122, 123, 136, 139, etc., are clipped thereby separating each of the major portions of the pantograph 90 into separate pieces. The link 100 is connected to the link 110 and the link 140. Specifically, the pin 106 of the link 100 is inserted into the bearing 113 and the pin 101 of the link 100 is inserted into the bearing 141. Thereafter, the pointer member 130 is connected by inserting the pin 132 thereof into the bearing 112 and the pin 133 into the bearing 142 of the link 140. The pointer 135 is bent downwardly 90° from the as molded condition and is hooked onto the tongue 135*c* to provide the structure in FIG. 6. Similarly, the rest 115 on the link 110 is bent 90° to hook under the shoulder 116*c* for the same purpose, thereby to position each of the pointers or rests 135 and 115 substantially perpendicular to the plane formed by the pantograph members, as illustrated in FIG. 6.

Finally, the holder 150 is inserted into the link 110 and specifically the beveled end 161 is inserted into the bearing 111 with the flange 162 limiting the vertical position of the rod 159.

In use, the clip 155 may be positioned on the edge of any suitable cardboard, paper or alternatively the pantograph 90 may be held by means of the tab 151 or the dowel 153. The pointer 135 is used to trace the figure to be reproduced and a writing instrument (not shown) inserted into the annular split ring holder 102 will trace out the figure and reproduce same at twice the scale.

Figure 7:
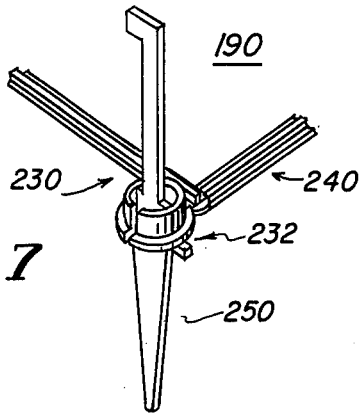
FIG. 7 is a perspective view of a third embodiment particularly illustrating the pointer portion thereof.
Figure 9:
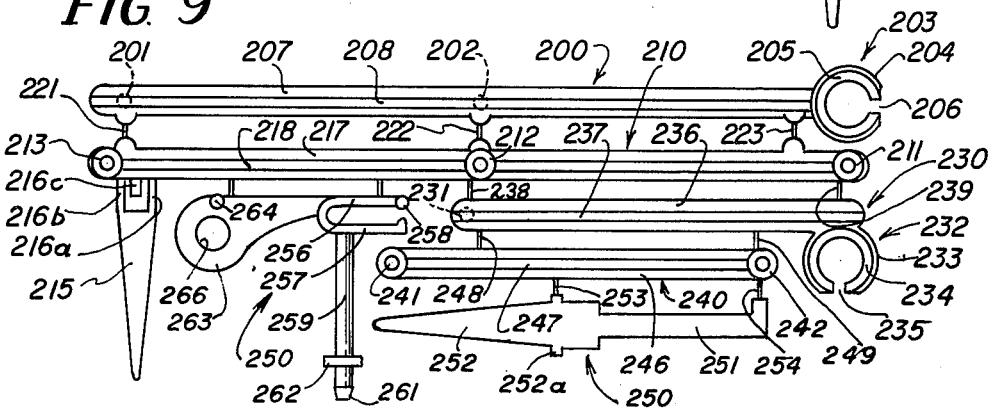
FIG. 9 is a plan view of the integrally molded plastic structure with the parts necessary to form the pantograph illustrated in FIG. 7.

Referring now to FIGS. 7 and 9, there is disclosed a third embodiment 190 of the present invention, with FIG. 9 showing the as molded condition and FIG. 7 showing the significant difference between the embodiment 190 and the embodiment 90. The principal difference is that the embodiment 190 permits easy reproductions of either double scale or one-half scale, depending on the location of the pointer, as will be described. Referring now to FIG. 9, there is shown an as molded construction in which there is provided a long link 200 having a stub shaft or pivot pin 201 extending perpendicularly from the link 200 at one end thereof, a pivot pin 202 extending perpendicularly from the link in the same direction as pin 201 in the middle thereof and a split ring connector 203 at the other end thereof. The split ring connector 203 comprises an annular flange 204 with an upstanding cylindrical wall 205, the wall 205 extending in the direction opposite to the pins 201 and 202. The annular flange 204 and the cylindrical wall 205 are split as at 206 to accommodate writing instruments of different diameters. The long link 200 in cruciform shaped in cross section with a flat member 207 having an upstanding ridges 208.

There is also provided a long link 210 having a bearing 211 at one end thereof, a bearing 212 centrally thereof and a bearing 213 at the other end thereof. Each of the bearings 211, 212 and 213 is provided with an opening sized to receive therein the pivot pin 201 or other stub shafts to be described. Each of the bearings is of a sufficient size to permit a snap fit with easy movement but not so loose as to permit the construction to fall apart. A rest 215 extends perpendicularly away from the member 210 adjacent the bearing 213 and is provided with a cut-out portion adjacent the juncture with the flat member 217 defining spaced apart straps 216*a* and 216*b* with a shoulder 216*c* therebetween. The long link 210 is of the same cruciform construction as the link 200, with a flat member 217 having upstanding strength providing ridges 218. The link 210 is connected to the link 200 by means of connectors 221, 222 and 223, each being of reduced diameter and each being adjacent an associated stub shafts 201, 202 or the holder 203.

There is also provided a short holder link 230, which has a pivot pin 231 extending perpendicularly away therefrom at one end thereof and a split ring holder 232 at the other end thereof. The split ring holder 232 is formed of a flat annular ring or flange 233 and an upstanding cylindrical wall 234, each being provided with a slit at 235 to accommodate writing instruments or pointers of different diameters. The short link 230 is cruciform shaped with a flat member 236 and upstanding strength providing ridges 237 and is connected to the long link 210 by means of the connectors 238 and 239.

A short link 240 has bearings 241 and 242 at the ends thereof with each of the bearings sized respectively to accommodate therein one of the aforementioned pivot pins. The link 240 is cruciform shaped with a flat member 246 and an upstanding strength providing ridges 247 and is connected to the short holder link 230 by means of reduced diameter connectors 248 and 249.

An auxiliary pointer 250 includes a shaft or shank 251 and a tapered head 252 having outwardly extending embossments **252*a* intermediate the pointed end and the wide end of the tapered head 252. The pointer 250 is connected to the short link 240 by means of connectors 253 and 254**.

A clip or holder 255 is provided and includes spaced apart prongs 256 and 257 which may be resilient, the prong 256 having a dowel 258 extending transversely thereof and the prong 257 having an upstanding rod 259 extending perpendicularly therefrom. The rod 259 is provided with a beveled edge 261 and a circular flange 262 rearward of the beveled edge 261 intermediate the end 261 and the prong 257. The clip 255 further includes a holder member 263 circular in shape with an aperture 266 and a dowel 264 extending transversely of the holder 263 and parallel to the dowel 258.

In operation, the pantograph 190 is assembled in the same manner as previously described with the exception that the alternate or auxiliary 250 may be positioned in either the split ring holder 232 or 203. When the auxiliary pointer which is a separate unit is positioned in the split ring holder 232, then the pantograph 190 operates in the same fasion as the pantograph 90, but when the auxiliary pointer 250 is positioned in the holder 203, then the pantograph 190 will provide reproductions one-half scale. Accordingly, it is seen that the embodiment 190 is easier to operate to provide reproduction either twice or one-half scale.

While there has been provided what at present is considered to be the preferred embodiments of the subject invention, it will be obvious that various modifications and alterations may be made therein without departing from the true spirit and scope of the subject invention, and it is intended to cover in the appended claims all such variations and modifications thereof.

What is claimed is:

1. A one-piece molded unit substantially rectangular in plan view having interconnected portions adapted for construction into a hand-held pantograph, said portions comprising first and second parallel interconnected long links, said first long link having a writing instrument holder at one end thereof, first connection means at the other end thereof and second connection means intermediate the link end, said second long link having a first connection means at one end thereof and second connection means at the other end thereof, first and second interconnected short links each having first and second connection means at the respective ends thereof said first and second interconnected links interconnected with said first and second long links and pointer means extending perpendicularly to one of said short links at one of the ends thereof adapted to snap fit into one of said connection means on the other short link at the end thereof, and anchoring means interconnected to at least one of said long links and having a hand-held rest connected thereto, said anchoring means having special apart flanges to snap fit within one of said second long link connection means to enable the user to anchor the assembled pantograph by hand during use, said connection means consisting only of pivot pins and apertured bearings to provide pivoting movement of the four links when assembled in either right-hand or left-hand configuration.

2. The one-piece molded unit set forth in claim 5, wherein the first and second short links are parallel to the first and second long links.

3. The one-piece molded unit set forth in claim 1, wherein one of said short links has a holder on one end thereof adapted to receive a writing instrument or a pointer, whereby the pantograph can easily reproduce double or one-half the size of the original.

4. The one-piece molded unit set forth in claim 1, wherein said anchoring means is a stand having an elongated base and spaced apart flanges on an upright to snap fit onto the other one of said second long link connection means.

5. The one-piece molded unit set forth in claim 1, wherein the one connection means on said second long link is a C-shaped open bearing.

* * * * *

UNITED STATES PATENT AND TRADEMARK OFFICE

CERTIFICATE OF CORRECTION

PATENT NO. : 4,158,257

DATED : June 19, 1979

INVENTOR(S) : SAM and DENNIS KUPPERMAN

It is certified that error appears in the above-identified patent and that said Letters Patent are hereby corrected as shown below:

olumn 2, line 58, "from" should be --form--.
olumn 3, line 16, "45" should be --46--;
line 41, "dissassemble" should be --disassemble--.
olumn 4, line 57, after "pivot" insert --pin--.
olumn 6, line 62, "shafts" should be --shaft--.
olumn 7, line 33, after "auxiliary" insert --pointer--.
olumn 8, line 24, "special" should be --spaced--.

Signed and Sealed this

*First* Day of *January 1980*

[SEAL]

*Attest:*

SIDNEY A. DIAMOND

*Attesting Officer*

*Commissioner of Patents and Trademarks*